US006264312B1

(12) United States Patent
Koitabashi et al.

(10) Patent No.: US 6,264,312 B1
(45) **Date of Patent: *Jul. 24, 2001**

(54) LIQUID SUPPLYING METHOD FOR LIQUID EJECTION HEAD AND LIQUID EJECTION RECORDING APPARATUS

(75) Inventors: Noribumi Koitabashi, Yokohama; Nobuyuki Kuwabara; Hitoshi Nishikori, both of Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/770,803

(22) Filed: Dec. 20, 1996

(30) Foreign Application Priority Data

Dec. 26, 1995 (JP) ..... 7-339253
Nov. 28, 1996 (JP) ..... 8-318024

(51) Int. Cl.[7] ..... B41J 2/175
(52) U.S. Cl. ..... 347/85
(58) Field of Search ..... 347/6, 7, 84, 85, 347/86, 87

(56) References Cited

U.S. PATENT DOCUMENTS

| | | | | |
|---|---|---|---|---|
| 4,831,389 | * | 5/1989 | Chan | 347/85 |
| 5,136,305 | * | 8/1992 | Ims | 347/7 |
| 5,159,348 | | 10/1992 | Dietl et al. | 347/89 |
| 5,162,817 | | 11/1992 | Tajika et al. | 347/7 |
| 5,216,450 | | 6/1993 | Koitabashi et al. | 347/87 |
| 5,619,238 | * | 4/1997 | Higuma et al. | 347/86 |
| 5,757,390 | * | 5/1998 | Gragg et al. | 347/7 |

FOREIGN PATENT DOCUMENTS

| | | |
|---|---|---|
| 3401071 | 7/1985 | (DE) . |
| 3542053 | 6/1987 | (DE) . |
| 322131 | 6/1989 | (EP) . |
| 640483 | 3/1995 | (EP) . |
| 640484 | 3/1995 | (EP) . |
| 719646 | 7/1996 | (EP) . |
| 63-15752 | 1/1988 | (JP) . |
| 2-217257 | 8/1990 | (JP) . |
| 5-96744 | 4/1993 | (JP) . |
| 6 40043 | 2/1994 | (JP) . |

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

A liquid supplying method for a liquid container of the type which uses a liquid accommodating container communicated to the atmosphere and filled with a negative pressure generating member to supply liquid to a liquid ejection head, with a liquid holding container communicating with a bottom section of the liquid accommodating container. According to the method, the amount of liquid supplied to the liquid holding container is automatically controlled in accordance with the amount of liquid remaining in the container. Also disclosed is a liquid ejection recording apparatus which includes a carriage which carries a head cartridge consisting of plural tank sections holding respectively different liquids and a recording head for performing recording, and which further includes large tanks holding large amounts of the same liquids as held in corresponding tank sections and being connectable to the tank sections of the head cartridge at a predetermined position. An erroneous supply preventing mechanism is provided so that wrong kinds of liquid may not be erroneously supplied between the large tanks and the tank sections of the head cartridge.

22 Claims, 13 Drawing Sheets

BEFORE CONNECTION

AFTER CONNECTION

BEFORE CONNECTION

AFTER CONNECTION

LIQUID SUPPLYING METHOD FOR LIQUID EJECTION HEAD AND LIQUID EJECTION RECORDING APPARATUS

BACKGROUND OF THE INVENTION

1. Field of the Invention

The present invention relates to a liquid supplying method for eventually supplying liquid to a liquid ejection head and to a liquid supplying device. In particular, the present invention relates to a system for supplying a liquid frequently used and to an ink jet recording apparatus equipped therewith.

2. Description of the Related Art

A recording head provided in an ink jet recording apparatus of this type can be mounted on a carriage which is fixed or reciprocated in a plane parallel to the recording material and in a direction perpendicular to the feeding direction of the recording material.

In such a scanning-type recording apparatus, the carriage is moved in a straight line by a predetermined command and, at the same time, ink droplets are ejected from the recording head in response to a predetermined signal to effect recording, and then the recording material is fed by a predetermined amount by a feeding device. These operations are repeated. Before or after image formation, the surface of the recording head on which ejection outlets are formed is capped to thereby effect a suction recovery operation, thereby keeping the ejecting section in the normal state.

The above-described recording head, which consumes ink when forming images, has to be constantly supplied with ink.

In one of the known methods for supplying ink to the recording head, an ink tank is provided at a position separate from the carriage and connected to the recording head through a tube. In this case, ink is supplied to the recording head by utilizing the head difference between the head and the ink tank.

In another method, a head cartridge is adopted, in which a negative pressure is generated in the ink tank with respect to the recording head to thereby detachably mount the ink tank on the carriage, forming the recording head and the ink tank as an integral unit. Such a head cartridge can be classified into two types: in one type, the recording head and the ink tank are constantly in an integrated state. In the other type, the recording head and the ink tank are formed as separate components, and both can be separated from the recording apparatus, the two components being united together when used.

The easiest way of generating such a negative pressure is to utilize the capillary action of a porous member (ink holding member). When this method is adopted, the ink tank includes a porous member such as a sponge accommodated for the purpose of storing ink and an atmospheric air communication opening for making it possible to take atmospheric air in the ink accommodating section to smooth the ink being used for printing.

To solve the problem of the porous member, which is rather poor in terms of ink accommodating capacity per unit volume, and to realize a stable ink supply, the present applicant has proposed in Japanese Unexamined Patent Publication No. 7-125232 a construction in which a porous member is inserted in a section of the ink tank.

FIG. 14 is a schematic sectional view showing an ink tank of the above-described construction. The interior of an ink tank 101 is divided into two spaces by a partition 103 having a communication hole 102. One space constitutes an ink accommodating chamber 104 which is tightly closed except for the communication hole 102 and which holds ink as it is without allowing it to come into contact with any other component. The other space constitutes an ink holding member accommodating chamber (atmosphere-communicating type liquid accommodating chamber) 106 for accommodating an ink holding member 105. In the walls defining this ink holding member accommodating chamber 106, there are formed an atmosphere-communication opening 107 for introducing atmospheric air as the ink is consumed, and a supply opening 108 for supplying ink to the recording head section. In this tank construction, when the ink of the ink holding member has been consumed by the recording head, air is introduced through the atmosphere communication opening into the ink holding member accommodating chamber and enters the ink accommodating chamber through the communication hole of the partition. As air is thus introduced, ink is fed from the ink accommodating chamber through the communication hole of the partition to fill the ink holding member in the ink holding member accommodating chamber. Thus, even when ink is consumed by the recording head, the absorbing member is filled with an amount of ink corresponding to the amount consumed, and the ink holding member holds a fixed amount of ink, keeping the negative pressure with respect to the recording head at a substantially constant level, whereby the ink supply to the recording head is stabilized. In particular, when, as in the case of Japanese Patent Unexamined Publication No. 6-40043, the passage for letting in atmospheric air is introduced and formed in the vicinity of the communicating section between the ink holding member accommodating chamber and the ink accommodating chamber, the ink supply can be effected in a more satisfactory manner.

In the above-described forms, whether they utilize head pressure or negative pressure, it is general practice for the ink tank to be replaced with a new one as soon as the ink has been used up. Hereinafter, this will be referred to as a "tank replacement system".

Another known ink supply system is a so-called pit-in system, in which a large-capacity tank for holding ink (hereinafter referred to as a "large tank") is provided and in which a head cartridge on which an ink tank and a recording head are integrally mounted is mounted on a carriage. The carriage is moved and the ink tank of the head cartridge (hereinafter referred to as the "tank section") is connected to the large tank at a predetermined position, whereby ink supply is effected. In this case, the ink tank constituting the tank section need not be replaced. Regarding the large tank, it is generally supplied with ink when all the ink therein has been consumed.

These conventional ink supply systems will be considered from the viewpoint of the supply of a frequently used ink. In the tank replacement system in which the head difference is utilized, it is necessary for the head difference between the tank and the recording head must be within a certain fixed range, so that an increase in the height of the ink tank is not possible. On the other hand, in the system adopting the form of head cartridge utilizing negative pressure, the cartridge is mounted on a reciprocating carriage, so that there is a limitation to the size of the ink tank. In either case, due to the limitation in tank size, the number of times that the ink tank is replaced increases in the case of a frequently used ink. Thus, these systems are disadvantageous from the viewpoint of stable ink supply.

On the other hand, those conventional systems in which ink is supplied to the tank section on the carriage, as in the case of the pit-in system, are not without their problems. In these systems, there is a variation in the ink level with respect to the space (volume) supplied with ink. Further, accurate supply of a fixed amount of ink is not possible. To overcome these problems, a system has been necessary in which any surplus amount beyond a predetermined amount of supplied ink is recovered (the overflow system), or a safety coefficient corresponding to the variation is used so that a very small amount of ink may be supplied. The former measure will lead to an increase in the size of the apparatus or waste of ink, and the latter measure will lead to an increase in non-recording period with the increase in the number of times that the ink supply is effected, resulting in a reduction in throughput.

The present invention has been made with a view toward solving the above problems in the prior art from a completely different point of view. It is a first object of the present invention to provide an ink supply system which can eliminate the above problems with a simple construction.

In the above-described conventional pit-in system, there is no need to replace the ink tank holding a frequently used liquid as in the case of the tank replacement system. However, when there are a plurality of such liquids, it is necessary to provide a plurality of large tanks corresponding to the tank sections accommodating these different liquids. In this case, there is a fear of wrong liquids being mixed with each other, i.e., color-mixing/liquid-mixing, if the wrong tank and the wrong tank section are connected to each other by an erroneous operation.

In particular, in some cases, before performing a predetermined recording in black ink, which is frequently used, the effect of fixing the color agent of the ink to the recording material is enhanced by processing the entire surface of the recording material with a processing liquid (hereinafter referred to as the "preprocessing liquid"). Such a processing liquid chemically reacts with the ink pigment to form insoluble matter (agents utilizing anion/cation reaction are known), so that, if the preprocessing liquid tank is connected with other tanks by erroneous operation, solidification will occur as a result of chemical reaction between the liquids, with the result that the ink tank, or in the worst case, even the recording head, become of no use. Thus, when the pit-in system in which a plurality of tank sections corresponding to the large tanks are provided is adopted, some measures must be taken to avoid color-mixing/liquid-mixing by erroneous operation.

Further, in the above-described pit-in system, when the construction in which the ink holding member is used as the negative pressure generating member in the tank section is adopted, supplying ink to the tank section from above results in a lot of time being required for the supplied ink to be supplied to the ink supply opening (usually provided in the lower section of the tank) to the head section. At the worst, air is allowed to enter the recording head to cause non-ejection.

In view of the above problems in the prior art, it is a second object of the present invention to provide a liquid ejection recording apparatus which adopts the pit-in system to reduce the number of times that the frequently used ink tank on the carriage is replaced is reduced, which prevents erroneous supply of different kinds of liquids, and which realizes a stable ink supply to the recording head.

SUMMARY OF THE INVENTION

To achieve the above objects, the present invention provides a liquid supplying method for a liquid ejection head of the type which uses an atmosphere communicating type liquid accommodating container filled with a negative pressure generating member to supply a liquid to a liquid ejection head, wherein there is provided a liquid holding container communicating with the bottom section of the atmosphere communicating type liquid accommodating container, the amount of liquid supplied to the liquid holding container being controlled on the basis of a judgment regarding the liquid holding condition of the liquid holding container.

In the above-described liquid supplying method, attention is paid to the negative pressure of the ink holding member to thereby provide a practical liquid supplying method which helps to achieve the first object of the present invention, making it possible to absorb the variation in the ink level detection of the optical system and the variation in supply amount.

In particular, when the liquid holding container is tightly sealed at the time of liquid consumption and at the time of liquid supply, it is possible to increase the amount of ink that can be accommodated per unit volume in the tank section, which is desirable since it makes it possible to further reduce the number of times that the supply operation is conducted.

Further, the present invention also provides, in addition to or apart from the above construction, an erroneous supply preventing mechanism which helps to prevent erroneous supply of different liquids between a plurality of large tanks and the tank sections of a plurality of head cartridges.

When a plurality of large tanks containing different liquids are provided and there are tank sections of a plurality of corresponding head cartridges, the above-described erroneous supply preventing mechanism prevents a large tank and a tank section of different liquids from being connected even in the case of erroneous operation, so that no color-mixing/liquid-mixing is generated. Thus, it is possible to provide a liquid ejection recording apparatus which adopts the pit-in system to reduce the number of times that the frequently used ink tank on the carriage is replaced, which prevents different liquids from being erroneously supplied, and which realizes a stable liquid supply to the recording head.

In such a recording apparatus, the tank section is formed as an integral tank composed of a liquid holding chamber which is practically sealed at least when ink is supplied and when ink is consumed and an atmosphere communicating type liquid accommodating chamber filled with an ink holding member having a negative pressure generating function, the liquid holding chamber and the atmosphere communicating type liquid accommodating chamber being separated from each other by a partition and communicating with each other only through a communication hole provided in the partition, the liquid holding chamber of the integral tank and the large tank being connected to each other at the time of liquid supply, whereby a stable ink supply can be advantageously realized.

Further, the tank section of the head cartridge is formed as an integral tank composed of a preparatory chamber for temporarily holding liquid from the large tank at the time of liquid supply, an atmosphere communicating type liquid accommodating chamber filled with an ink holding member having a negative pressure generating function, and a partition which allows the preparatory chamber and the atmosphere communicating type liquid accommodating chamber to communicated with each other only through a communication hole, an opening being provided in the preparatory chamber of the integral tank so that the integral tank and the large tank are connected to each other through this opening at the time of liquid supply.

Further, in accordance with the present invention, there is provided a liquid ejection recording apparatus of the type in which a plurality of head-tank sets of each consisting of an ink jet recording head and an ink tank connected thereto or a plurality of head cartridges each consisting of a recording head and an ink tank united together into an integral unit are mounted and arranged on a carriage capable of moving relative to a recording material to form color images on the recording material, wherein, of the ink tanks, a particular ink tank having relatively large capacity has an ink receiving mechanism, the particular ink tank being supplied with ink at a predetermined position by supplying means.

BRIEF DESCRIPTION OF THE DRAWINGS

FIGS. 6A and 6B are diagrams illustrating another example of the inlet of the tank section of the second embodiment of the present invention, of which FIG. 6A shows the condition before the connection with the supply needle of the large tank; and FIG. 6B shows the condition after the connection;

FIGS. 7A and 7B are diagrams illustrating still another example of the inlet of the tank section of the second embodiment of the present invention, of which FIG. 7A shows the condition before the connection with the supply needle of the large tank; and FIG. 7B shows the condition after the connection;

FIGS. 11A, 11B and 11C are conceptual drawings showing a color printer constituting a liquid ejection apparatus according to a third embodiment of the present invention, of which FIG. 11A shows the condition in which the ejecting section of each head cartridge is capped, FIG. 11B shows the ink supply condition of the head cartridge for black ink, and FIG. 11C shows the sucking position of a head cartridge for a color ink;

FIGS. 12A, 12B and 12C are conceptual drawings showing a color printer constituting a liquid ejection apparatus according to a fourth embodiment of the present invention, of which FIG. 12A shows the condition in which the ejecting section of each head cartridge is capped, FIG. 12B shows the ink supply condition of the head cartridge for a preprocessing liquid, and FIG. 12C shows the ink supply condition of the head cartridge for black ink;

DESCRIPTION OF THE PREFERRED EMBODIMENTS

Embodiments of the present invention will now be described with reference to the drawings.

Figure 1:
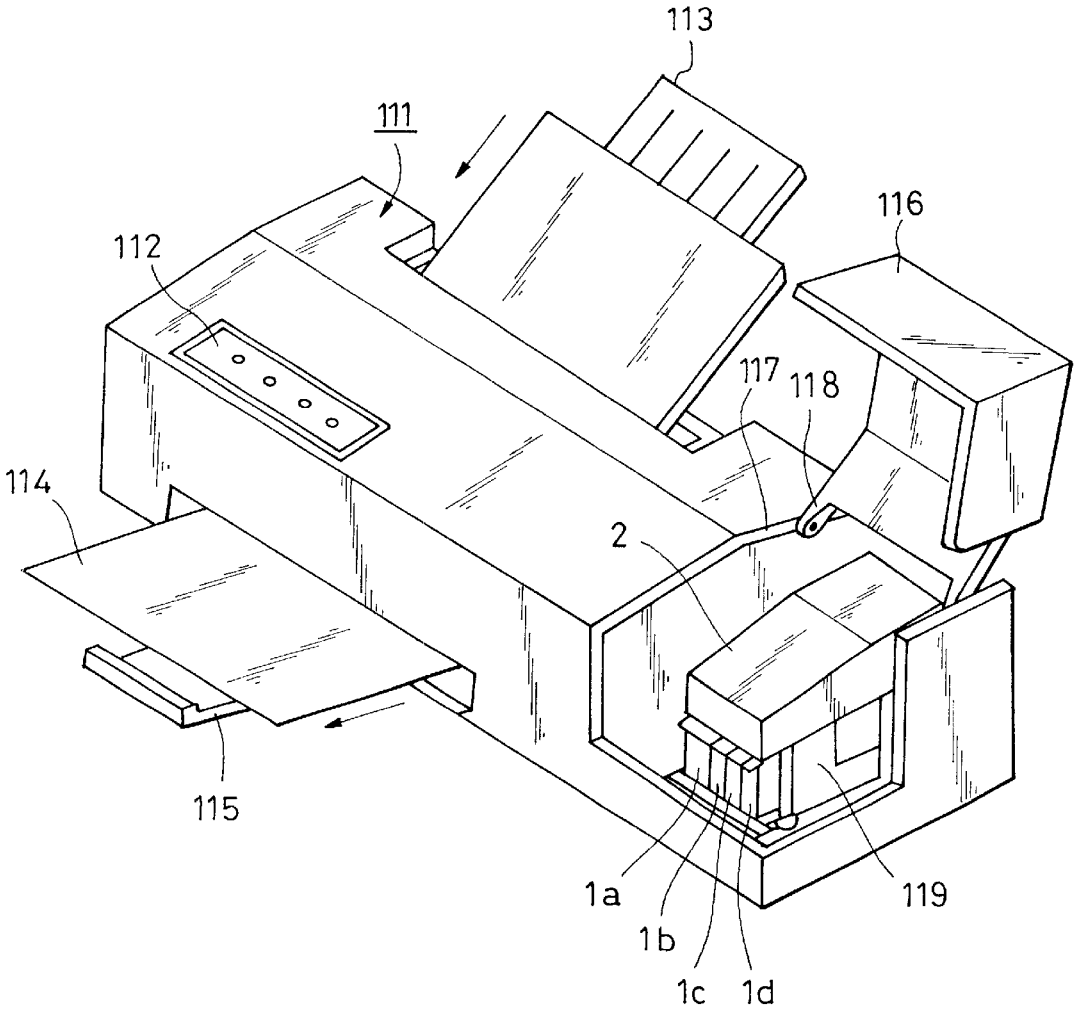
FIG. 1 is a schematic perspective view showing a color printer constituting a liquid ejection apparatus according to an embodiment of the present invention.

FIG. 1 is a schematic perspective view showing a color printer constituting a liquid ejection apparatus according to an embodiment of the present invention.

In FIG. 1, an operating panel 112 is provided on the front portion of the upper surface of the housing of an liquid ejection recording apparatus (color printer) 111. Numeral 113 indicates a paper feeding tray for holding paper (recording medium) before recording; numeral 114 indicates a sheet of paper discharged through a paper feeding path inside the printer 111; and numeral 115 indicates a paper discharge tray for holding the sheet of paper 114. Numeral 116 indicates a main body cover which covers an opening 117 formed in the right front portion of the housing. The main body cover is rotatably mounted at the inner end of the opening 117 by a hinge 118. Further, a carriage 119 supported by a guide or the like (not shown) is arranged inside the housing. The carriage 119 is provided so as to be capable of reciprocating in the width direction of the sheet of paper passing the above-mentioned paper feeding path. On this carriage, there are provided head cartridges (1*a*, 1*b*, 1*c* and 1*d*) each consisting of an integral unit of a head and each of ink tanks for accommodating inks of black (B), cyan (C), magenta (M) and yellow (Y), respectively. Numeral 2 indicates a large tank for black ink, which is supplied to the head cartridge 1*a* by a supply method described below.

Next, ink supply systems corresponding to the kinds of tanks supplied with inks, used in the tank sections of the liquid ejection recording apparatus of the present invention, will be described with reference to FIGS. 2 through 10.

(First Embodiment)

Figure 2:
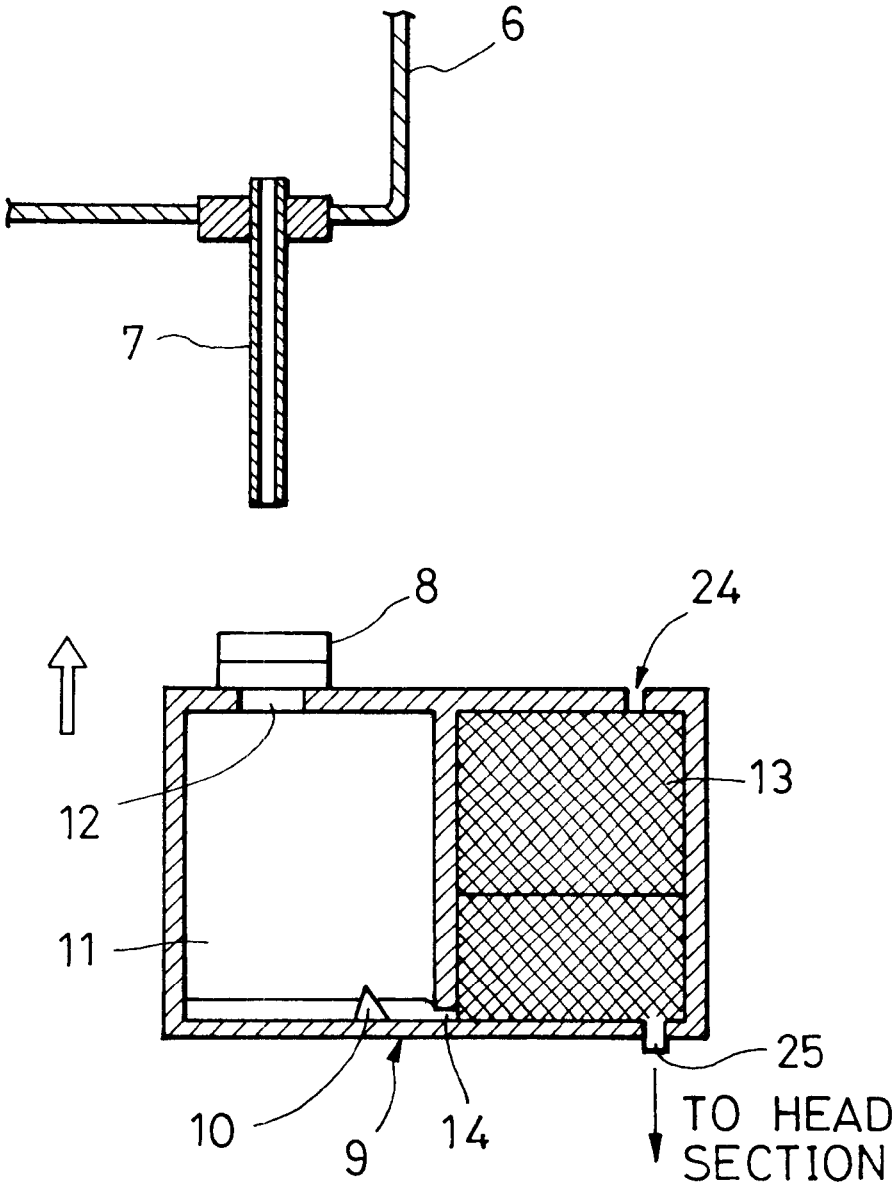
FIG. 2 is a schematic diagram illustrating connection and supply between a large tank and a tank section in a first embodiment of the present invention.

FIG. 2 is a schematic diagram illustrating the connection and supply between the large tank and the tank section in a first embodiment of the present invention.

As shown in FIG. 2, an inlet 12 through which a supply needle 7 of a large tank 6 holding liquid is inserted is provided in a wall forming an ink accommodating chamber 11 of a tank section 9 of a head cartridge for accommodating a frequently used liquid. This inlet 12 is tightly sealed by a double valve mechanism 8 for preventing the ink accommodating chamber 11 from communicating with the atmosphere at the time of insertion of the needle. An ink holding member accommodating chamber 13 is provided with an atmosphere communicating opening 24 and an ink supply outlet 25 for supplying ink to the recording head.

The insertion of the supply tube 7 into the inlet 12 is effected when the tank section 9 moves to the large tank 6 side through the movement of the head cartridge. At this time, the supply tube 7 is inserted into the inlet 12 through the double valve mechanism 8, so that the ink accommodating chamber 11 can always be kept in a sealed state without communicating with the atmosphere. The double valve mechanism 8 consists of a first valve chamber (not shown) and a second valve chamber (not shown). When the forward end of the supply needle 7 enters the first valve chamber 1, the second valve chamber, which communicates with the ink accommodating chamber, is closed, the forward end of the needle being only allowed to enter the second valve chamber after the sealing with the first chamber has been secured.

The remaining amount of ink in the ink accommodating chamber 11 is monitored by an optical level detector 10 provided at the bottom of the ink accommodating chamber 11. When it is determined by a control unit (not shown) from the detection result of this optical level detector 10 that the remaining amount of ink is small, tanks of the same kind are connected to each other by a command from the control unit, and liquid is supplied from the large tank 6 to the tank section 9 of the head cartridge through the supply tube 7.

It is necessary for the above determination on the basis of the detection by the optical level detector 10 to be made before the ink in the region in the vicinity of the communicating portion of the ink holding member in the ink holding member accommodating chamber has been used up. It is desirable for the determination to be made before the ink in the ink accommodating chamber 11 for holding ink has been used up. This is due to the construction of this ink tank. When the liquid flow through the communication hole 17 of the partition separating the ink accommodating chamber 11 and the ink holding member accommodating chamber 13 from each other is interrupted, gas-liquid exchange between the ink accommodating chamber 11 and the ink holding member accommodating chamber 13 at the time of liquid consumption by the head section becomes impossible, and there is a fear of liquid supply from the ink accommodating chamber 11 to the ink holding member accommodating chamber 13 becoming impossible.

While in the example of FIG. 2 the optical level detector 10 is provided at the bottom of the ink accommodating chamber 11, this should not be construed restrictively. It is also possible to judge the level of the ink accommodating chamber 11 from the amount of liquid consumed by the recording head and supply the requisite amount of ink. For example, the number of droplets (dots) ejected from the recording head which makes the ink accommodating chamber 11 completely empty may be ascertained beforehand, and the control unit may be provided with a set value obtained by adding a safety value to this dot count value to prevent the ink accommodating chamber 11 from becoming completely empty, supplying an amount of liquid corresponding to the set value whenever this set value is reached. This arrangement helps to minimize the requisite time for liquid supply. Further, when the tank section of the head cartridge adopts a partial tank structure, the liquid supply to the recording head is stabilized.

Figure 3:
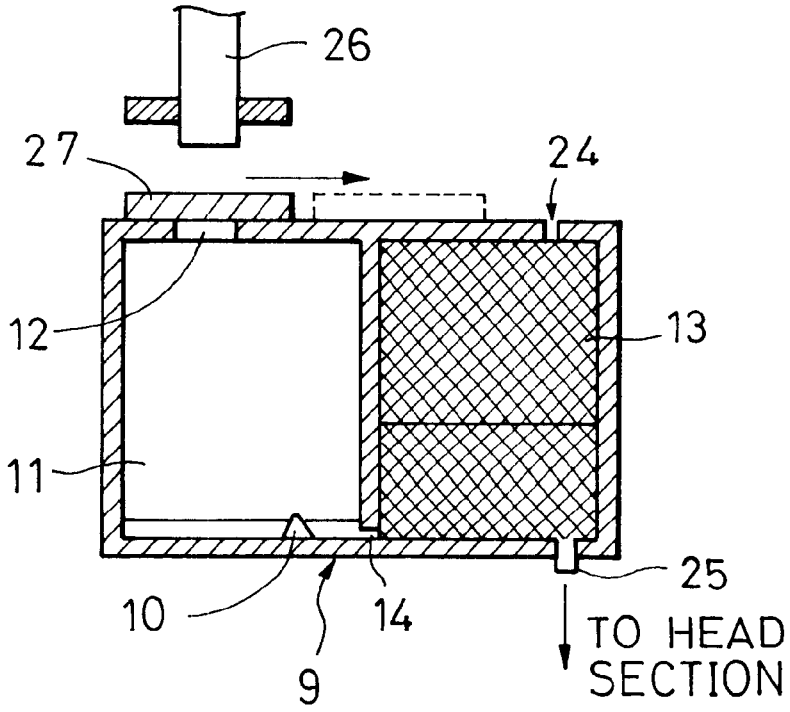
FIG. 3 is a schematic diagram illustrating another form of connection and supply between the large tank and the tank section in the first embodiment of the present invention.

Further, instead of the double valve mechanism and the ink supply tube, it is also possible to use a slide plate 27 and an ink supply tube 26 as shown in FIG. 3 to seal the ink accommodating chamber at the time of ink supply and ink consumption. Any opening/closing mechanism will serve the purpose as long as this action is possible. In this case, even if the ink accommodating chamber is opened to the atmosphere during the connecting operation, the opening period is very short, so that, even if some liquid flows to the ink holding member side, it is sufficiently possible for the liquid to be held by the ink holding member, whereby it is possible to prevent ink from being inadvertently flowing out of the recording head.

(Second Embodiment)

Figure 4:
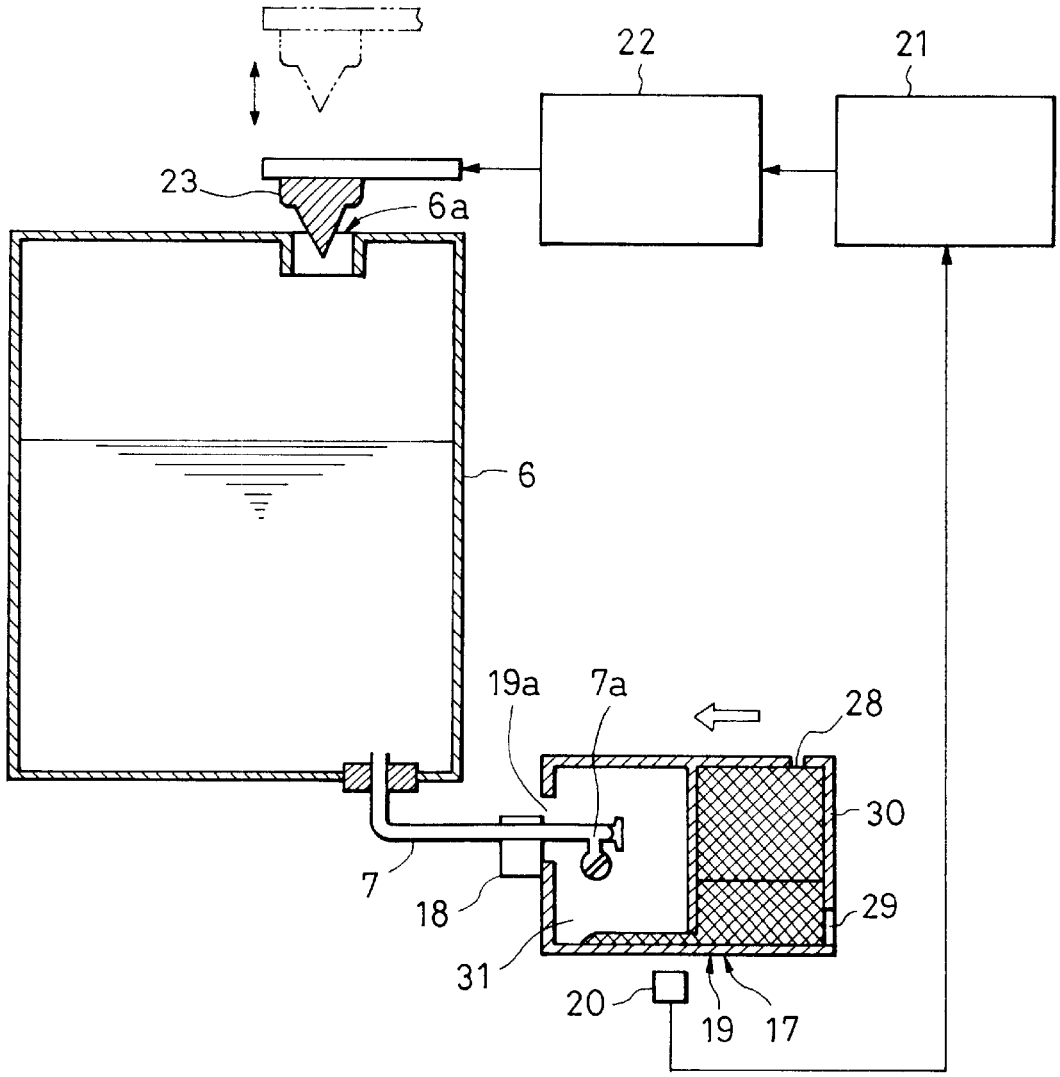
FIG. 4 is a schematic diagram illustrating connection and supply between a large tank and a tank section in a second embodiment of the present invention.
Figure 5:
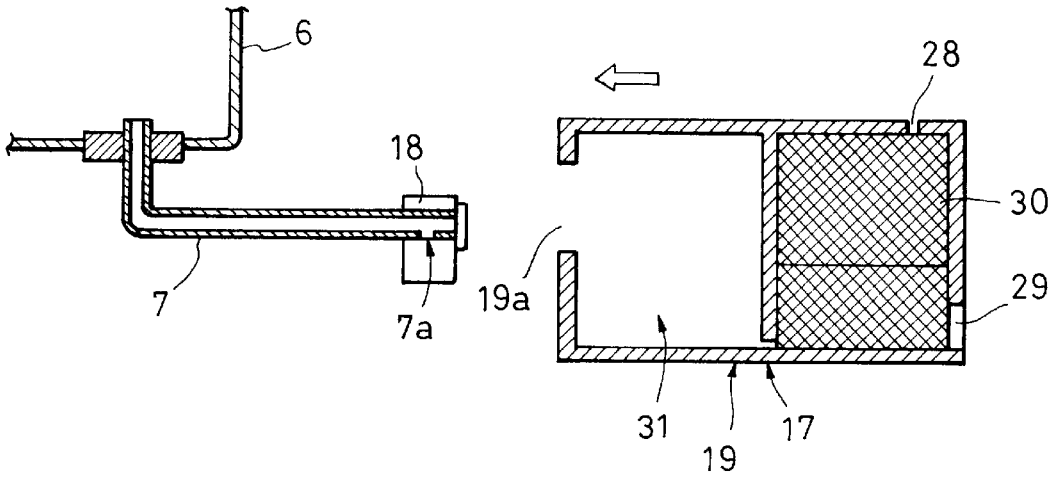
FIG. 5 is a schematic diagram illustrating the condition in which a supply needle of the large tank is not inserted into the inlet of the tank section of the second embodiment of the present invention.

FIG. 4 is a schematic diagram showing a system for supplying ink from a large tank to a tank section accommodating ink holding member according to a second embodiment of the present invention. FIG. 5 is a diagram illustrating the condition in which the supply needle of the large tank is not inserted into the inlet of the tank section. This second embodiment differs from the above-described first embodiment in that the portion corresponding to the ink accommodating chamber of the first embodiment (hereinafter referred to as a "preparatory chamber") is a system open to the atmosphere during the consumption of liquid by the recording head.

That is, in this embodiment, the tank section is composed of an ink holding member accommodating chamber 30 and a preparatory chamber 31, the ink holding member accommodating chamber 30 communicating with the preparatory chamber 31 through a communicating section 17 at the bottom. As in the first embodiment, the ink holding member accommodating chamber has an atmosphere communicating opening 28 and an ink supply outlet 29 and contains an ink holding member. It is only necessary for the preparatory chamber 31 to have a function by which it temporarily holds ink to be supplied to the absorbing member holding chamber equipped with an ink absorbing member at the time of liquid supply described below. In the case of this embodiment, an inlet 19*a* is provided, whereby the chamber is made open to the atmosphere.

On the other hand, the large tank has an atmosphere communicating opening 6*a*, which is normally closed by a valve body 23. To the bottom of the large tank, a supply needle 7 for supplying liquid to the preparatory chamber of the tank section is connected. As shown in FIG. 5, the supply opening 7*a* at the forward end of the supply needle is closed by a sealing section 18 when it is not connected to the tank section, whereby leakage of ink from the forward end of the needle is prevented.

Next, the connecting operation in this embodiment will be described with reference to FIGS. 4 and 5.

The insertion of the supply needle 7 into the inlet 19*a* is effected by moving the tank section to the large tank side by moving the head cartridge. At this time, when the sealing section 18 abuts the inlet 19*a*, the sealing section is retained there and only the supply needle 7 is inserted into the preparatory chamber, so that the supply opening 7*a* is reliably opened within the preparatory chamber. To realize this mechanism, for example, iron is used on the side of the sealing section 18 abutting the tank section, and a magnet or the like is used on the side of the tank section abutting the sealing section.

The amount of ink in the preparatory chamber of the tank section 19 is monitored by an optical sensor 20. When a control unit 21 permits ink supply in a sequence described below according to the detecting result of this sensor, a valve body driving device 22 is driven by a command from the control unit 21, and the valve body 23 closing the atmosphere communicating hole 6*a* of the large tank 6 is opened for a fixed period of time, whereby a fixed amount of ink is supplied from the supply opening 7*a* at the forward end of the supply needle 7 to the preparatory chamber 31 of the tank section 19.

The ink thus supplied is supplied to the ink holding member accommodating chamber 30 from the preparatory chamber 31 through the communicating hole 17. Since the communicating hole 17 is at the bottom of the container having the ink supply outlet 29 leading to the head section, it is possible to directly supply ink to the remaining ink in the ink absorbing member, thereby making it possible to prevent air from intruding the recording head (not shown). Further, when, as in this embodiment, the communicating hole 17 is arranged at a position spaced apart from the ink supply outlet 29 leading to the head section, little air is allowed to enter the recording head side during printing operation, whereby it is advantageously possible to perform a more stable printing.

Next, the sequence of liquid supply in this embodiment will be described with reference to FIGS. 8A through 8F and FIGS. 9A through 9F. FIGS. 8A through 8F and FIGS. 9A through 9F are diagrams illustrating a method of detecting the liquid accommodating amount of the tank section in the connection and supply between the large tank and the tank section according to the second embodiment of the present invention. In FIGS. 8A through 8F and FIGS. 9A through 9F, numeral 35 indicates an ink supply duct for supplying ink to the recording head section (not shown). In the partition above the communication hole 17, there is provided a passage capable of introducing air. Further, in FIGS. 8A through 8C and FIGS. 9A through 9C, the variation in level of the preparatory chamber 31 and the ink holding member accommodating chamber is indicated by solid lines and arrows.

In FIG. 8, in the liquid supply operation mentioned above, a predetermined amount of ink is supplied from the large tank to the preparatory chamber 31, and absorbed by the ink holding member through the communication hole 17. FIGS. 8A through 8F show the relationship between the level of the ink holding member and the change with time in the amount of ink in the preparatory chamber 31 during this operation. That is, when the level of the ink holding member changes from that of FIG. 8A to that of FIG. 8C, the amount of ink in the preparatory chamber 31 undergoes a change with time as shown in FIGS. 8D through 8F.

Figure 8A:
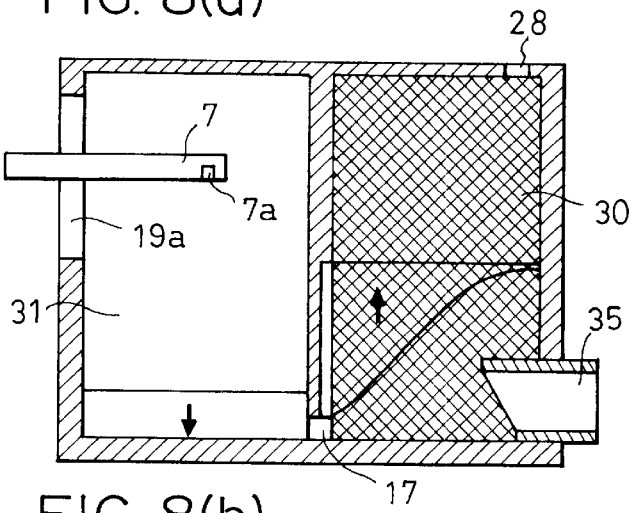
FIGS. 8A, 8B, 8C, 8D, 8E and 8F are diagrams illustrating a method of detecting the liquid accommodating amount of the tank section in the connection and supply between the large tank and the tank section in the second embodiment of the present invention.
Figure 8D:
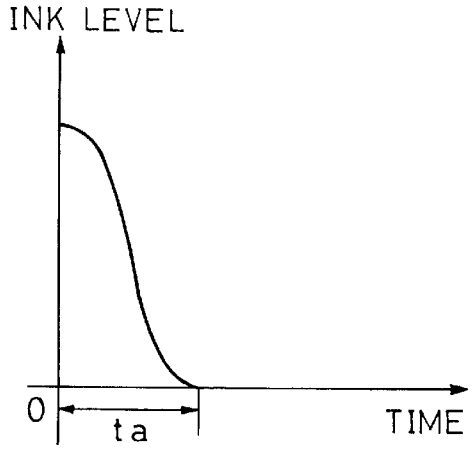
Figure 8B:
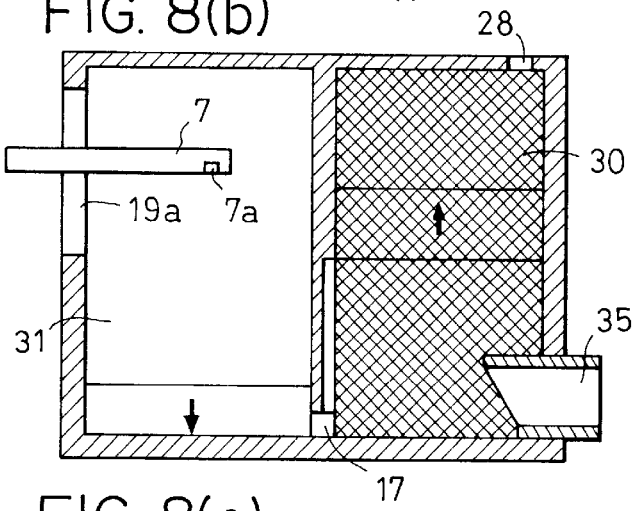
Figure 8E:
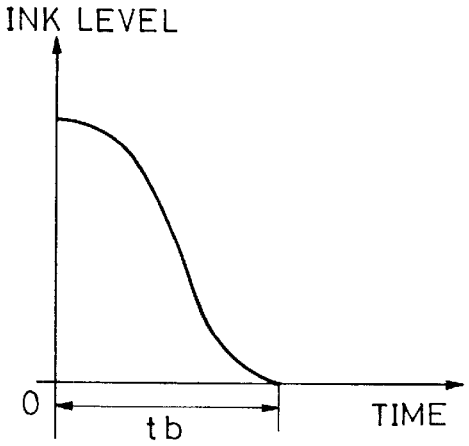
Figure 8C:
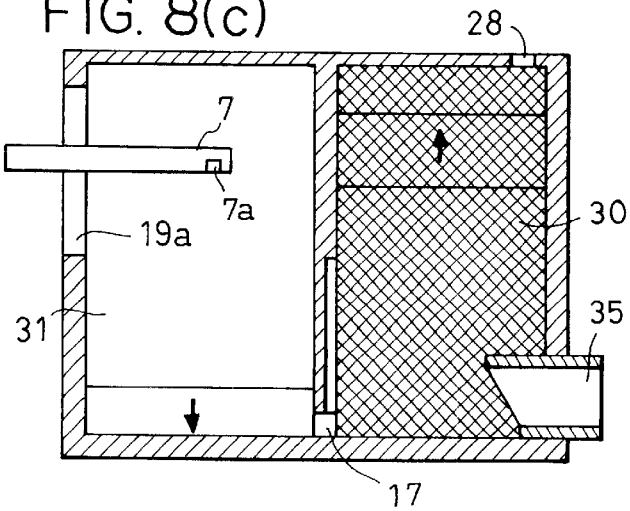
Figure 8F:
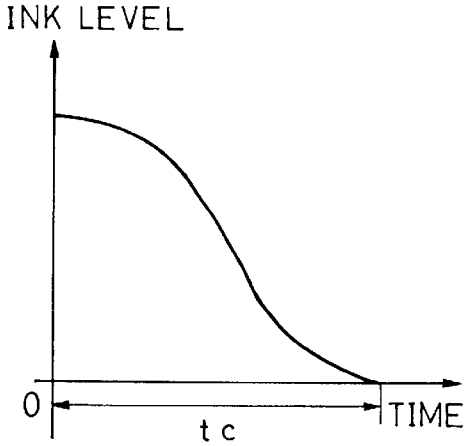

When the level of the ink holding member is low as shown in FIG. 8A, the negative pressure generating power of the ink holding member is large, so that ink is sucked up with a large force, the ink moving to the ink holding member in a short time (ta) as shown in FIG. 8D. On the other hand, when the level of the ink holding member is high as shown in FIG. 8C, the negative pressure generating power of the ink holding member is small, so that ink is sucked up with a small force, the ink moving to the ink holding member in a longer time (tc) as shown in FIG. 8F. In this way, in this embodiment, the time it takes for the ink to be sucked up (ta, tb, tc) varies in accordance with the level of the ink holding member.

In view of this, in this embodiment, the time it takes for the ink to be removed from the preparatory chamber is detected by using an optical sensor provided in the vicinity of the communication hole at the bottom of the preparatory chamber, whereby the level of the ink holding member is detected and the control unit makes a judgment as to whether a predetermined amount of ink can be supplied again or not. That is, when the time it takes for the ink to be sucked up is short, a command to permit the supply of a predetermined amount of ink again is issued, and when the time it takes for the ink to be sucked up is long, a command to prohibit the supply of a predetermined amount of ink again is issued.

Due to this arrangement, it is possible to provide an ink supply method which does not entail ink leakage and in which the number of times that ink supply has to be conducted is small.

Figure 9A:
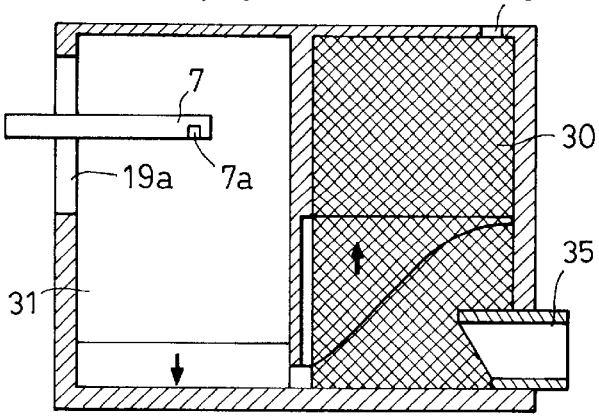
FIGS. 9A, 9B, 9C, 9D, 9E, and 9F are diagrams illustrating another method of detecting the liquid accommodating amount of the tank section in the connection and supply between the large tank and the tank section in the second embodiment of the present invention.
Figure 9D:
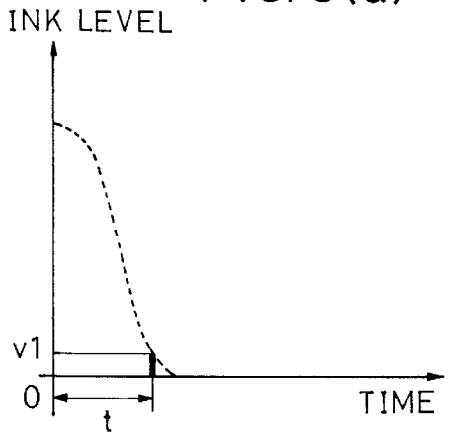
Figure 9B:
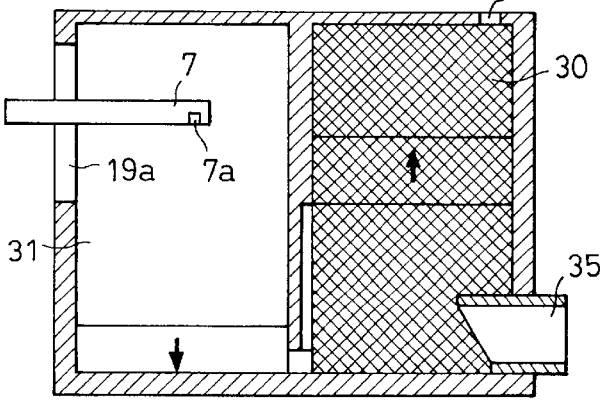
Figure 9E:
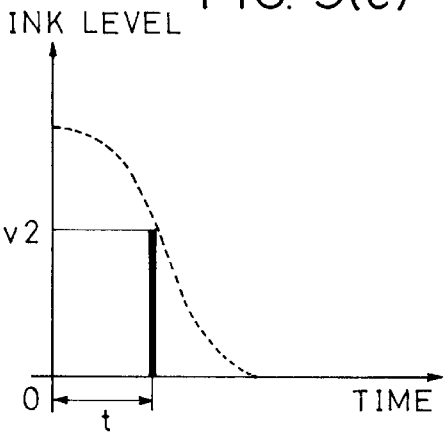
Figure 9C:
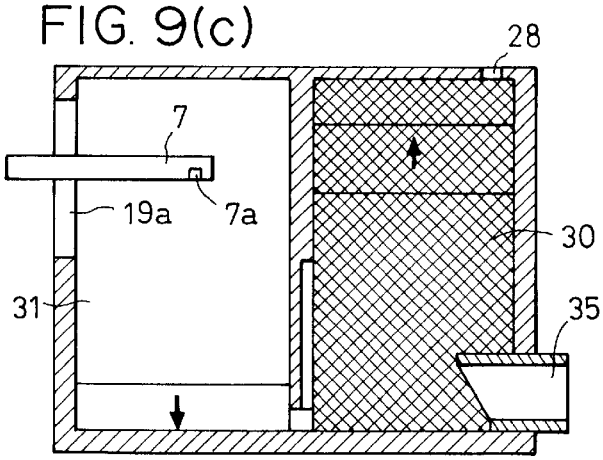
Figure 9F:
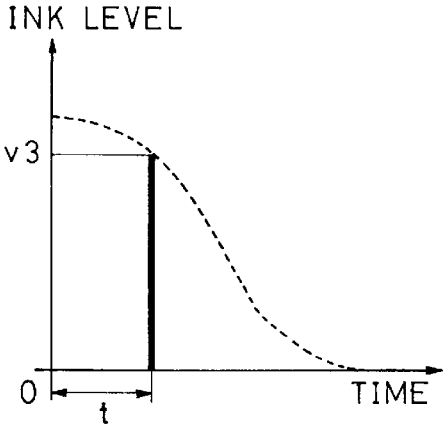

Instead of measuring the time it takes for the ink in the preparatory chamber to be used up, it is also possible, as shown in FIGS. 9A through 9F, to detect the remaining amount of ink in the preparatory chamber after a predetermined time (t) to thereby detect the level of the ink holding member, causing the control unit to make a judgment as to whether it is possible to supply a predetermined amount of ink again. In this case, when the level of the ink holding member is low as shown in FIG. 9A, the remaining amount of ink after a predetermined time (v1) is small as shown in FIG. 9D, and when the level of the ink holding member is high as shown in FIG. 9C, the remaining amount of ink after the predetermined time (v3) is large as shown in FIG. 9F. The amount of ink in the preparatory chamber can be judged, for example, through measurement of the voltage of the light receiving section of the optical sensor and comparison of the values measured.

Both in the case of FIGS. 8A through 8F and in the case of FIGS. 9A through 9F, the timing with which the ink supplying operation is to be started can be determined by judging the remaining amount of ink in the in holding member accommodating chamber from the amount of liquid consumed by the recording head. For example, the number of droplets (dots) ejected from the recording head which causes the liquid in the ink holding member accommodating chamber to be completely used up is checked beforehand, and a safety value which helps to prevent the ink holding member accommodating chamber from becoming completely empty is added to this dot count value. The set value thus obtained is provided in the control unit for supply operation (not shown), the supply operation being started whenever this set value is reached. Further, it is also possible to set a predetermined period of time within a range which does not cause the ink to be used up even when printing is effected solidly all over the recording material, the supply operation being started in accordance with the period of time thus preset. Alternatively, it is also possible to arrange such that the supply operation is started at an arbitrary point in time utilizing a period of time which is not related to printing operation.

In any case, by starting supply operation utilizing a period of time not related to printing operation, for example, the time when the recording material is discharged after recording, it is possible to realize an ink supply without affecting throughput.

Next, a modification of this embodiment will be described.

Figure 6A:
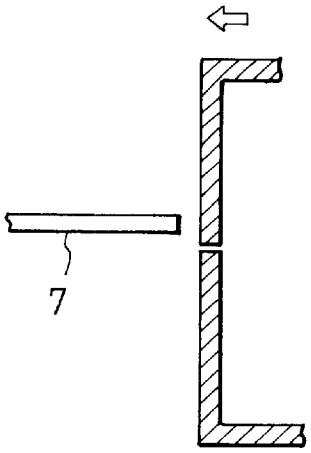
Figure 6B:
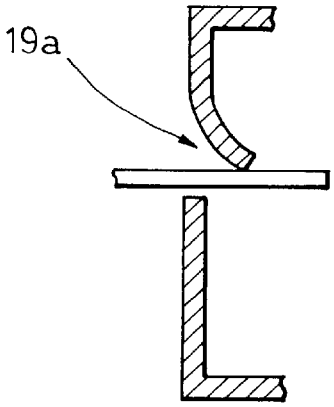
Figure 7A:
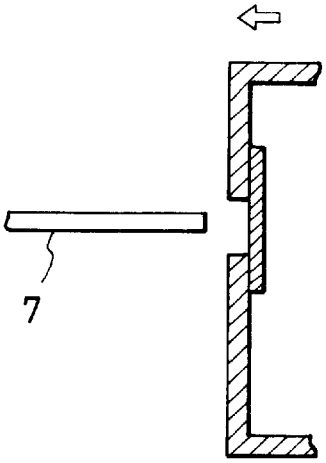
Figure 7B:
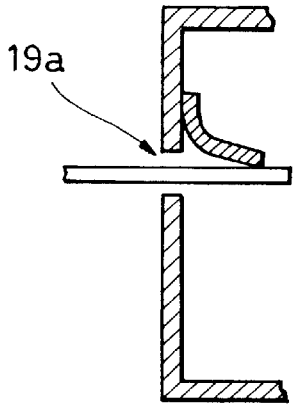

FIGS. 6A, 6B, 7A and 7B are diagrams illustrating other examples of the inlet of the tank section of the second embodiment of the present invention, of which FIGS. 6A and 7A show the condition before the connection with the supply needle of the large tank; and FIGS. 6B and 7B show the condition after the connection.

In both the structures shown in FIGS. 6 and 7, a part of the inlet 19 is or the valve mechanism is formed of an elastic material such as rubber, so that, when the supply needle is inserted, it flexibly opens and, when the needle is taken out, the major portion of the opening is closed. In the case of this construction, when the supply needle is connected, the preparatory chamber becomes open to the atmosphere.

When in the above-described embodiment the liquid supply is not conducted, it is desirable, from the viewpoint of reducing ink evaporation through the communication hole from the preparatory chamber to the absorbing member accommodating chamber, it is more desirable for the opening portion to be small as shown in FIG. 6 or to provide a valve mechanism as shown in FIG. 7 to form a closed state when liquid supply is not effected than to provide a large opening portion as shown in FIG. 5. Thus, when the preparatory chamber is to be kept in the tightly closed state, it is desirable to provide the absorbing member holding chamber with a buffer function for preventing ink leakage or to provide the preparatory chamber with a one-way valve or the like for dissipating the pressure in the preparatory chamber in order to cope with the expansion of the air in the preparatory chamber due to a rise in the environmental temperature.

Figure 10A:
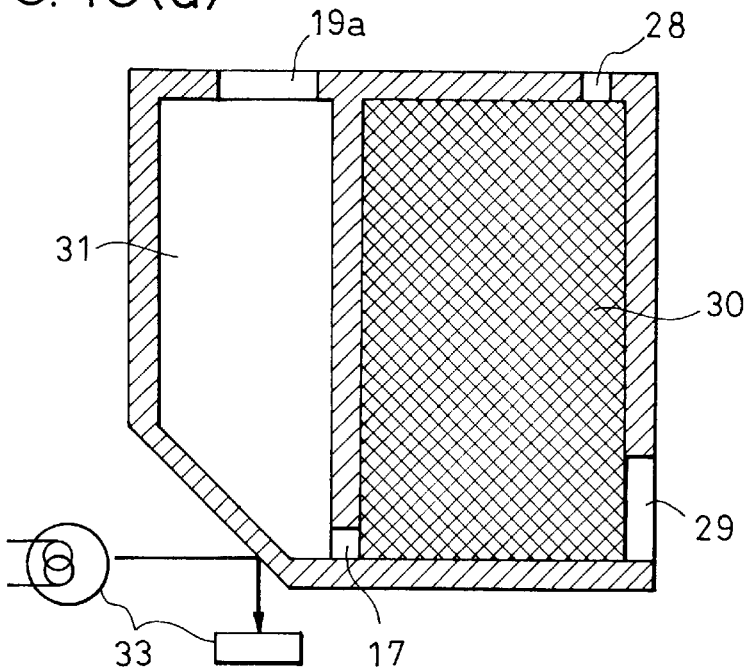
FIGS. 10A and 10B are diagrams illustrating other examples of the liquid detecting device used in the second embodiment of the present invention.
Figure 10B:
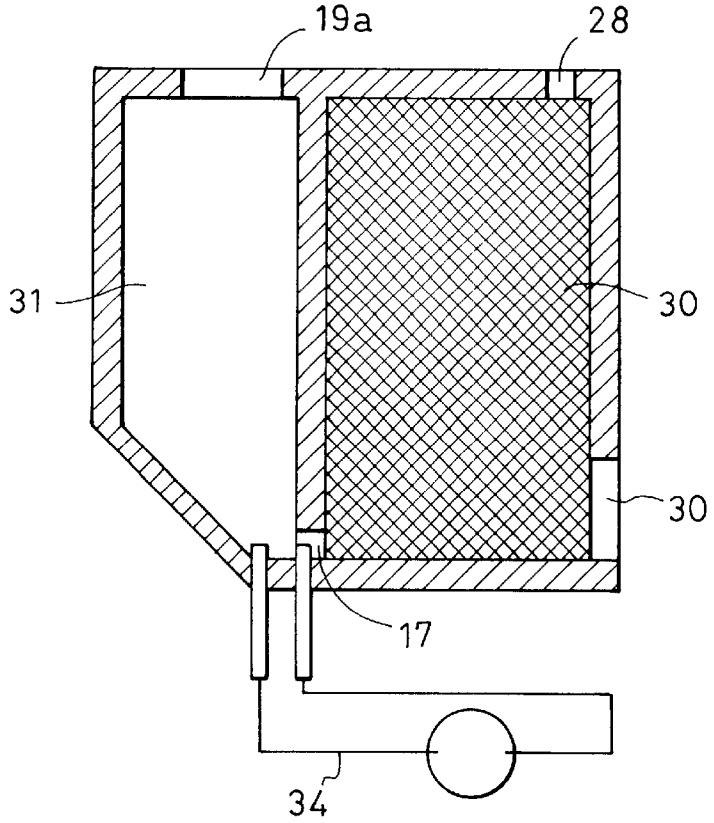

FIGS. 10A and 10B are diagrams illustrating other examples of the liquid detecting device used in the second embodiment of the present invention.

In FIG. 10A, the bottom section 32 of the preparatory chamber 31 is inclined and made transparent to thereby make it possible to detect the difference in the reflection amount by an optical sensor 33 according to the presence of ink. In this case, the bottom section 32 of the preparatory chamber is inclined toward the communication hole 17, whereby the ink in the preparatory chamber 31 can be reliably absorbed by the ink holding member. Further, in FIG. 10B, a pair of electrodes 34 are provided in the vicinity of the communication hole instead of the optical sensor.

In the liquid supply methods in accordance with the first and second embodiments of the present invention, the liquid is directly supplied to the liquid holding chamber or the preparatory chamber, so that the requisite time for liquid supply is relatively short. Further, either method is applicable not only to the case of the pit-in system but also to the case, for example, in which the tank section of the head cartridge and the large tank are directly connected to each other through a tube. In this case, a one-way valve or the like is provided in the tube connecting the large tank to the tank section of the head cartridge and, further, the sealing property of the joint section between the tube and the ink accommodating chamber is secured, whereby it is possible for the ink accommodating chamber to be practically sealed except for the communication at the bottom when liquid is supplied from the ink accommodating chamber to the ink holding member accommodating chamber.

However, from the viewpoint of a reduction in the device size, the pit-in system is superior in that there is no need for a tube to be stretched around. In view of this, next, the pit-in connecting operation used in the liquid ejection recording apparatus of the present invention will be described with reference to FIGS. 11 through 13.

(Third Embodiment)

Figure 11A:
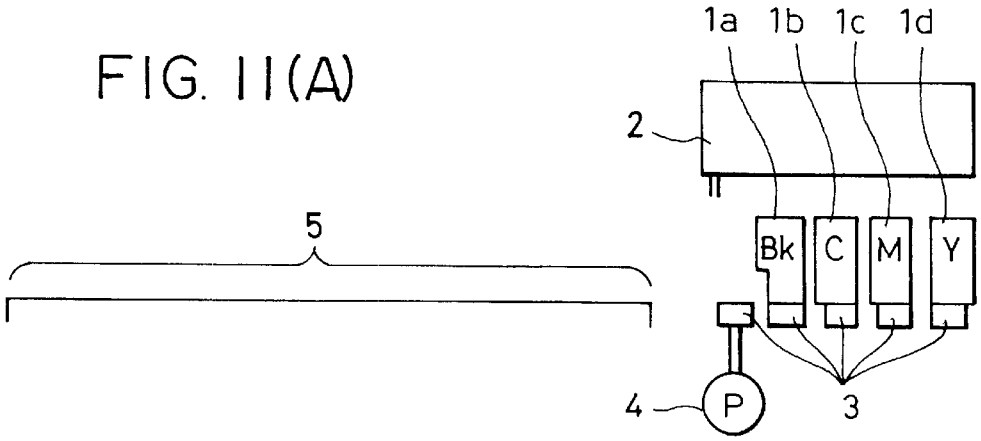
Figure 11B:
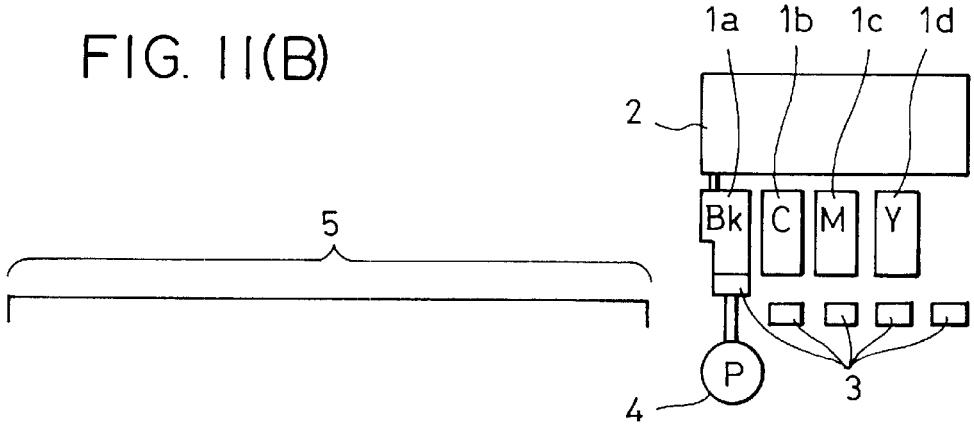
Figure 11C:
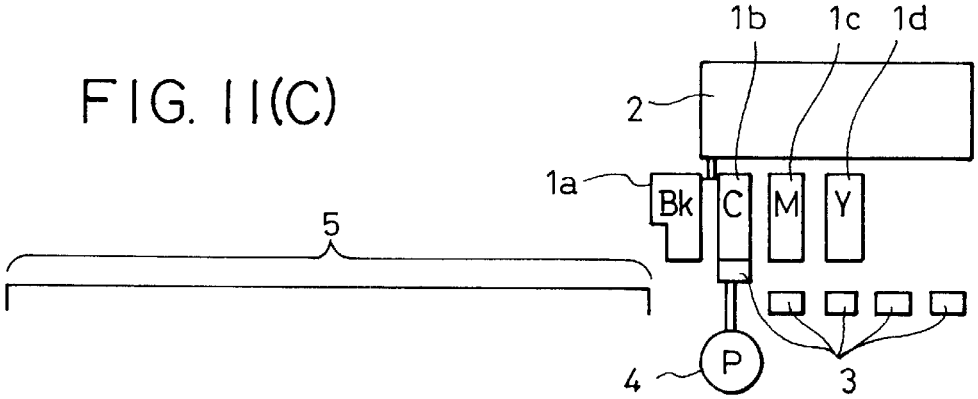

FIG. 11 is a conceptual drawing showing a color printer constituting a liquid ejection recording apparatus according to a third embodiment of the present invention. FIG. 11A shows the condition in which the ejecting section of each head cartridge is capped; FIG. 11B shows the ink supply condition of the head cartridge for black ink; and FIG. 11C hows the sucking position of the cartridge for a color ink.

In the color printer constituting the third embodiment, the pit-in system is adopted for the black ink, which is frequently used. As shown in FIG. 11, a home position as a printing stand-by position is provided on one outer side of the printing region 5. In this home position, five caps 3 are arranged side by side, of which the cap 3 nearest to the printing region has a suction recovery pump 4.

In the home position of the carriage, the large tank 2 for black ink having a supply needle is arranged on the side opposite to the group of caps with respect to the head cartridges. The above-mentioned cap 3 having the suction recovery pump 4 is capable of moving with respect to the large tank 2 for black ink.

Between the large tank 2 and the group of caps, there are provided head cartridges 1*a* through 1*d* for inks of four colors for color printing, Bk (black), C (cyan), M (magenta) and Y (yellow) mounted on a carriage (not shown) capable of moving to the right and left in FIG. 11, are opposed to the respective caps so as to be capable of close contact.

Further, the head cartridges 1*a* through 1*d* may be of the type in which the ink tank and the recording head are combined into an integral unit or of the type in which the ink tank and the recording head can be detached from each other. In this embodiment, the carriage (not shown) is movable such that the head cartridges 1*a* through 1*d* are brought into close contact with the caps 3 at the home position and when the cap having the pump 4 is moved toward the large tank 2 to push the head cartridges 1*a* through 1*d*.

Further, here, the configuration of the head cartridge 1*a* for black ink is different from that of the other head cartridges 1*b*, 1*c* and 1*d*. It has an inlet section corresponding to the supply needle of the large tank 2. At the position where it is opposed to the cap 3 having the suction recovery pump 4, the supply needle of the large tank 2 for black ink is inserted only into the tank section of the head cartridge 1*a* for black ink on the carriage. That is, the configuration of the ink tank of the head cartridge 1*a* for black ink is different from that of the other head cartridges, and ink is supplied to this particular ink tank. Thus, when a head cartridge other than that for black ink is at the suction recovery position, connection between different inks is not effected even when the head cartridge is erroneously moved to the side of the large tank for black ink.

Next, with reference to FIGS. 11A through 11C, the connecting operation between the large tank and the head cartridges (pit-in operation) will be described.

As shown in FIG. 11A, at the position, the ink ejection outlet of each of the head cartridges 1*a* through 1*d* is closed by being in close contact with a cap. When, as shown in FIG. 11B, the carriage moves to the suction position for the head cartridge 1*a* for black ink, and the remaining amount of ink in the tank section of the head cartridge la for black is found to be small, the cap 3 having the suction recovery pump 4 is brought into close contact with the ejecting section of the head cartridge 1*a* for black ink and, in this close-contact state, the head cartridge 1*a* for black ink is pushed, with the result that the large tank 2 for black ink and the tank section of the head cartridge 1*a* are connected to each other to make it possible to conduct ink supply. As described below with reference to the third embodiment, this connection is effected when the supply needle of the large tank 2 is inserted into the inlet of the tank section.

Further, as shown in FIG. 11C, when a head cartridge for some other color, such as the head cartridge lb for cyan ink, is moved to the suction position, the supply needle of the large tank 2 for black ink is not connected to the tank section even when the cap 3 having the suction recovery pump 4 pushes that head cartridge as a result of an erroneous operation.

In this way, in the third embodiment of the present invention, even when a tank section which is not to be supplied with ink from the large tank is at the position of the large tank and even it is moved to the large tank side by erroneous operation, the supply needle is not inserted into it due to the difference in tank configuration, thereby preventing erroneous ink supply.

(Fourth Embodiment)

Figure 12A:
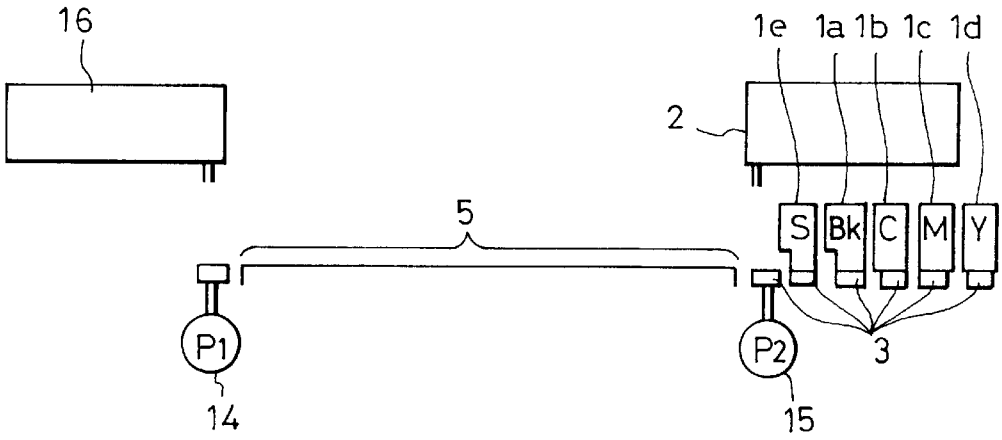
Figure 12B:
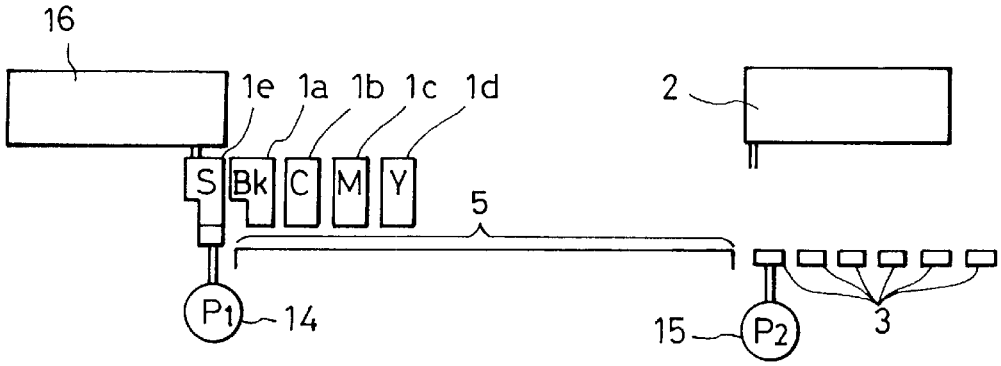
Figure 12C:
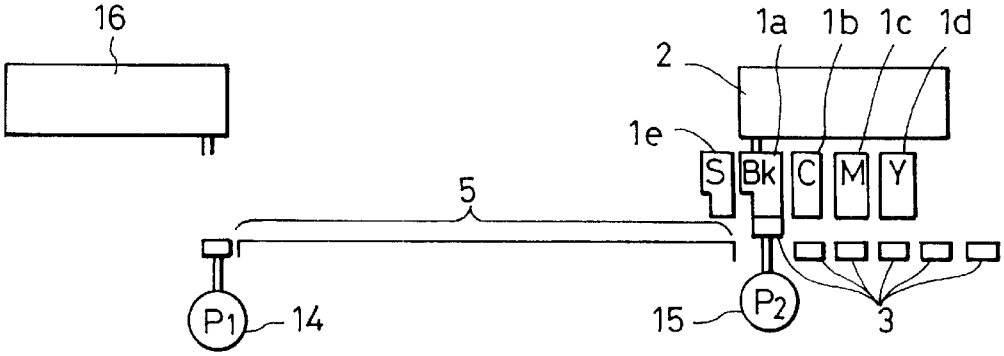

FIGS. 12A through 12C are conceptual drawings showing a color printer constituting a liquid ejection apparatus according to a fourth embodiment of the present invention, of which FIG. 12A shows the condition in which the ejecting section of each head cartridge is capped, FIG. 12B shows the ink supply condition of the head cartridge for a preprocessing liquid, and FIG. 12C shows the ink supply condition of the head cartridge for black ink. In these drawings, the components which are the same as those of the third embodiment are indicated by the same reference numerals.

In the color printer according to the fourth embodiment, the pit-in system is adopted for both black ink, which is frequently used, and a preprocessing liquid. As shown in FIG. 12, a home position as a printing stand-by position is provided on one outer side of the printing region 5. In this home position, six caps 3 are arranged side by side, of which the cap that is nearest to the printing area 5 has a suction recovery pump 15.

In the home position of the carriage, a large tank 2 for black ink having a supply needle is arranged on the opposite side of the group of caps with respect to the head cartridges. The above-mentioned cap 3 having the suction recovery pump 15 is movable with respect to the large tank 2 for black ink. Further, on the opposite side of the home position with respect to the printing area 5, there are arranged a suction pump 14 for preprocessing liquid and a large tank 16 for preprocessing liquid having a supply needle. The suction pump 14 for preprocessing liquid is movable with respect to the large tank 16 for preprocessing liquid.

Between the large tanks 2, 16 and the group of caps, there are arranged a head cartridge 1*e* for preprocessing liquid, and head cartridges 1*a* through 1*d* for the four colors of Bk (black), C (cyan), M (magenta) and Y (yellow) mounted on a carriage capable of moving to the right and left in FIG. 12 such that they can be brought into close contact with the respectable caps arranged opposite to them.

Further, the head cartridges 1*a* through 1*e* may be of the type in which the ink tank and the recording head are combined into an integral unit or of the type in which the ink tank can be detached from the recording head. In this embodiment, the carriage (not shown) is movable such that the caps 3 are brought into close contact with the head artridges 1*a* through 1*e* at the home position and when the head cartridges 1*a* through 1*e* are pushed by the movement of he caps having the pumps 15 and 14 toward the large tanks 2 and 16.

Further, here, the configuration of the head cartridge 1*a* for black ink and that of the head cartridge 1*e* for reprocessing liquid are different from that of the other head cartridges 1*b*, 1*c* and *d*. They have an inlet section corresponding to the supply needle of the large tank 2, 16. At the position opposite to the cap 3 having the suction recovery pump 15, only the head cartridge 1*a* for black ink on the carriage is connected to the large tank 2 for black ink. At the position opposite to the cap having the suction pump 14 for preprocessing liquid, the head cartridge 1*e* for preprocessing liquid on the carriage is connected to the large tank 16 for preprocessing liquid.

However, when, as described above, a plurality of large tanks are provided and there are a plurality of tank sections supplied with liquid in correspondence with the large tanks, there is a fear of connection between different inks by erroneous operation, resulting in different inks or liquids being mixed with each other. In view of this, a construction will be described below in which the tank section of the head cartridge supplied with liquid is provided with an erroneous supply preventing mechanism.

Figure 13A:
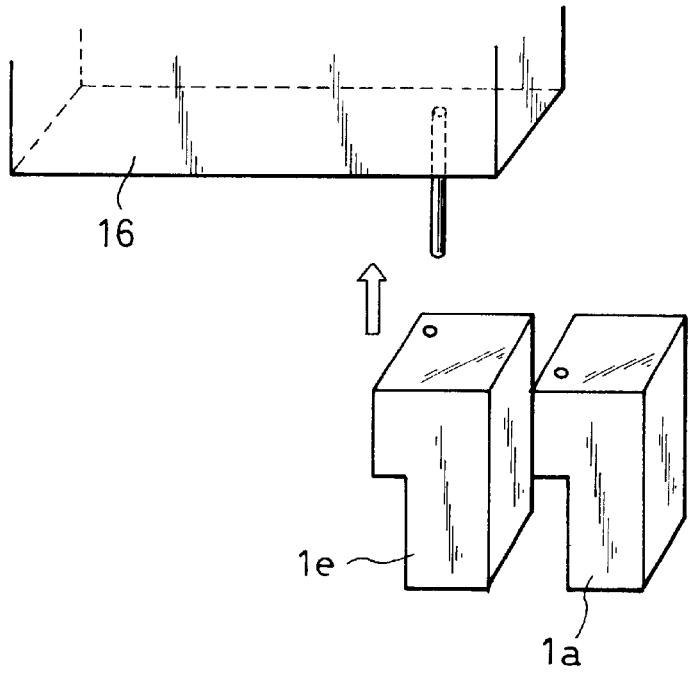
FIGS. 13A and 13B are diagrams showing an erroneous supply preventing mechanism in the color printer of the fourth embodiment of the present invention.
Figure 13B:
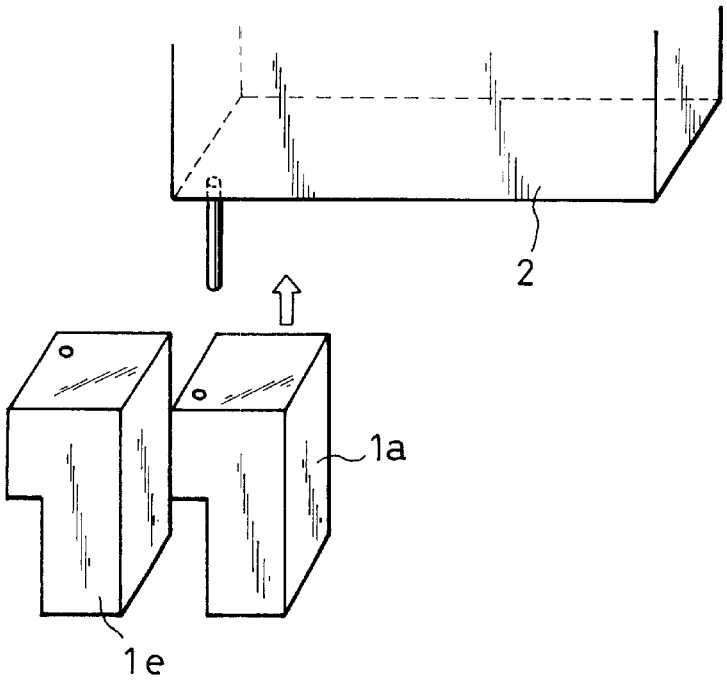
Figure 14:
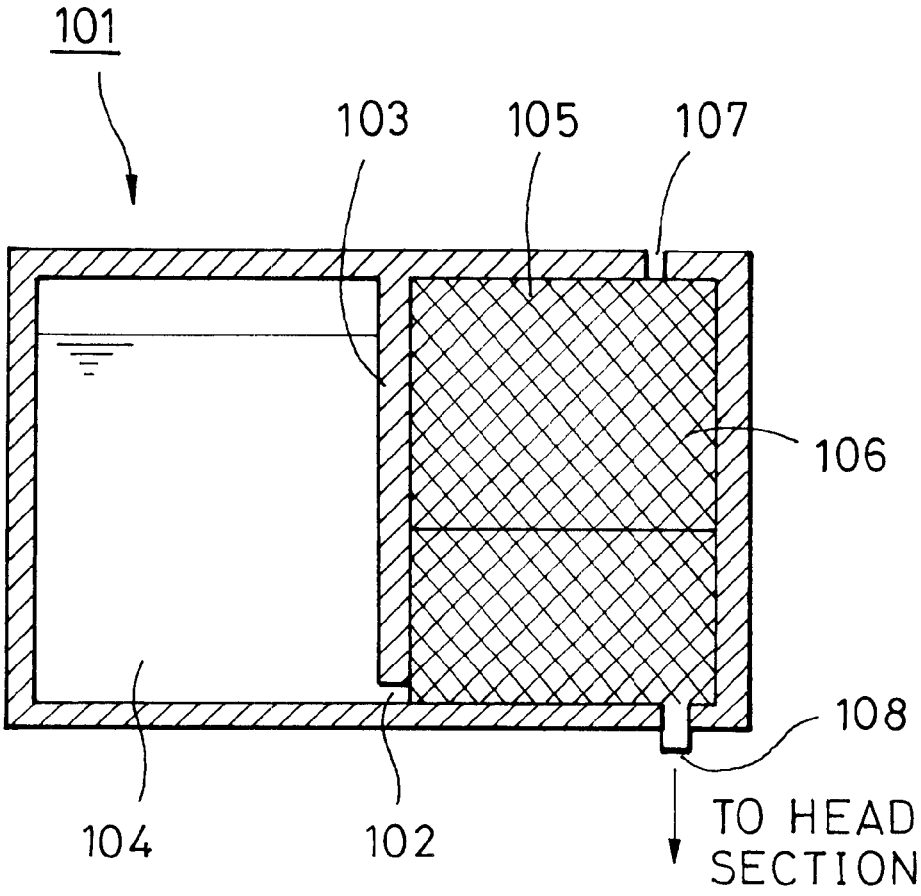
FIG. 14 is a schematic sectional view showing an ink tank utilizing a construction as proposed by the present applicant.

FIGS. 13A and 13B are diagrams showing an erroneous supply preventing mechanism in the color printer of the fourth embodiment of the present invention. As shown in these drawings, the position of the inlet of the head cartridge 1*a* for black ink is different from that of the inlet of the head cartridge 1*e* for preprocessing liquid, into which the supply needle of the large tank 16 for preprocessing liquid is to be inserted. Further, the position of the supply needle of the large tank for black ink is also made different so as to be in correspondence with the inlet of the head cartridge 1*a* for black ink.

Thus, while in FIG. 13A the head cartridge 1*e* for preprocessing liquid can be connected to the large tank 16 for preprocessing liquid, the head cartridge 1*a* for black ink is not connected to the large tank 16 for preprocessing liquid by erroneous operation even when the head cartridge 1*a* for black ink is brought to the supply position where the supply from the large tank 16 for preprocessing liquid is to be conducted. Further, while in FIG. 13B the head cartridge 1*a* for black ink can be connected to the large tank 2 for black ink, the head cartridge 1*e* for preprocessing liquid is not connected to the large tank 2 for black ink by erroneous operation even when the head cartridge 1*e* for preprocessing liquid is brought to the supply position where the supply from the large tank 2 for black ink is to be conducted. Thus, mixing of wrong liquids can be prevented. This mechanism, however, should not be construed restrictively.

Next, with reference to FIGS. 12A through 12C, the connecting operation between the large tank and the head cartridge (pit-in operation) will be described.

As shown in FIG. 12A, the carriage (not shown) is movable and the ink ejection outlets of the head cartridges 1*a* through 1*e* are in close contact with the caps 3.

When the remaining amount of liquid in the tank section of the head cartridge 1*e* for preprocessing liquid is small, the carriage moves to the supply position where the liquid supply by the large tank 16 for preprocessing liquid is to be conducted, and the cap having the suction pump 14 for preprocessing liquid is brought into close contact with the ejecting section of the head cartridge 1*e* for preprocessing liquid and, at the same time, in this close contact state, the head cartridge 1*e* for preprocessing liquid is pushed, with the result that, as shown in FIG. 12B, the supply needle of the large tank 16 for preprocessing liquid is inserted into the tank section of the head cartridge 1*e* for preprocessing liquid, whereby the large tank 16 for preprocessing liquid and the head cartridge 1*e* for preprocessing liquid are connected to each other, thereby making it possible to supply preprocessing liquid.

When the remaining amount of liquid in the tank section of the head cartridge 1*a* for black ink is small, the carriage moves to the position where the liquid supply from the large tank 2 for black ink is to be conducted, as shown in FIG. 12C, and the cap 3 having the suction recovery pump is brought into close contact with the ejecting section of the head cartridge 1*a* for black ink and, in this close contact state, the head cartridge 1*a* for black ink ink is pushed, with the result that the supply needle of the large tank 2 for black ink is inserted into the tank section of the head cartridge 1*a* for black ink, whereby the large tank 2 for black ink and the head cartridge 1*a* for black ink are connected to each other, thereby making it possible to conduct ink supply.

When a head cartridge of some other color, for example, the head cartridge 1*b* for cyan color, is at the position of the suction pump, the supply needle of the large tank does not abut the tank section of that head cartridge even if the cap having the suction pump is brought into close contact with the ejecting section of the head cartridge of that color and the head cartridge of that color is pushed.

As described above, in accordance with the third and fourth embodiments of the present invention, in the so-called pit-in system, a plurality of head cartridges with tanks containing different kinds of liquid are mounted on a carriage, and at least one of a plurality of large tanks containing liquids of the tank sections of the head cartridges is set, providing an erroneous supply preventing mechanism so that wrong kinds of liquid may not be supplied between the large tank and the tank section of the head cartridge, whereby it is possible to reduce the number of times that the tank section containing a frequently used liquid can be reduced and to prevent color-mixing/liquid mixing from occurring as a result of connection between the wrong large tank and the wrong tank section by an erroneous operation.

What is claimed is:

1. An ink supplying method for supplying ink to an ink container which is provided in an ink jet recording apparatus, the ink container in turn supplies ink to an ink ejection head, the ink container having a first chamber provided with a negative pressure generating member which generates negative pressure to the liquid ejection head and an atmosphere-communication opening communicating with the atmosphere, and a second chamber which is next to said first chamber in communication with the first chamber so as to form a substantially closed space except for said communication, the ink supplying method comprising the step of supplying ink to the second chamber while the second chamber is substantially closed to the atmosphere, an amount of ink supplied to the second chamber being controlled in accordance with an amount of ink remaining in said second chamber;

wherein said supplying step is performed while said ink container is provided in said ink jet recording apparatus and the ink which is supplied to said second chamber by said supplying step is absorbed into the negative pressure generating member in said first chamber.

2. An ink supplying method for supplying ink to an ink container which is provided in an ink jet recording apparatus and which in turn supplies ink to an ink ejection head, the ink container having a first chamber provided with a negative pressure generating member which generates negative pressure to the liquid ejection head and an atmosphere-communication opening communicating with the atmosphere, and a second chamber which is next to said first chamber communicating with the first chamber and which is open to the atmosphere, the ink supplying method comprising the step of supplying ink to the second chamber by ink supplying means, an amount of the ink supplied to the second chamber being controlled in accordance with an amount of ink remaining in said second chamber;

wherein said supplying step is performed at a predetermined position inside of said ink jet recording apparatus and said second chamber and said ink supplying means are not connected except in a state of said supplying step, and wherein said supplying step has control means for controlling in order that the ink which is supplied to said second chamber by the supplying step is absorbed into the negative pressure generating member in said first chamber.

3. An ink supplying method according to claim 2, wherein, in the supplying step, the amount of ink held by said negative pressure generating member is determined by the period of time from a time that a predetermined amount of ink has been supplied to said second chamber until a time that the predetermined amount of ink has been absorbed by said negative pressure generating member.

4. An ink supplying method according to claim 2, wherein the amount of ink held by said negative pressure generating member is judged by the amount of ink in said second chamber after a predetermined period of time from the moment a predetermined amount of ink has been supplied to said second chamber.

5. An ink supplying method, wherein the ink supplying method according to claim 2 is performed on a first liquid container for supplying a first liquid to a first liquid ejection head, and wherein a liquid supplying method different from said ink supplying method is performed on a second liquid container for supplying a second liquid to a second liquid ejection head, the respective supply of the first and second liquids each being performed by a different supply control mechanism.

6. An ink supplying method according to claim 5, wherein the second liquid is a reaction liquid reacting with the first ink.

7. A liquid ejection recording apparatus comprising:

a carriage which carries plural head cartridges each of which includes a tank section holding a liquid and a recording head for performing recording on a recording material, each said tank section holding a respectively different kind of liquid, said carriage being arranged to reciprocate along a straight line that is parallel to said recording material; and plural large tanks each holding a large amount of the same liquid as held in a corresponding one of said plural tank sections, and each being connectable to the corresponding one of the plural tank sections at a predetermined position to thereby supply liquid to the tank section;

wherein said plural large tanks and said corresponding one of the plural tank sections are not connected except in a state to supply the liquid to said tank sections; and wherein respective positions of inlets provided in said plural tank sections for connecting to said large tanks are provided at respectively different positions so that a wrong kind of liquid is prevented from being erroneously supplied between said plural large tanks and said plural tank sections.

8. A liquid ejection recording apparatus according to claim 7, wherein the tank section of each said head cartridge is formed as an integral tank comprising a preparatory chamber for temporarily holding liquid from the large tank at the time of liquid supply, an atmosphere communicating type liquid accommodating chamber filled with an ink holding member having a negative pressure generating function, and a partition which allows communication between said preparatory chamber and said atmosphere communicating type liquid accommodating chamber only through a communication part, an opening being provided in the preparatory chamber of said integral tank, said integral tank and said large tank being connected to each other through said opening at the time of liquid supply.

9. A liquid ejection recording apparatus according to claim 8, further comprising detecting means for judging the liquid holding condition of the preparatory chamber of said integral tank and a control section for controlling so as to supply a predetermined amount of liquid according to the output of said detecting means, the liquid holding amount of said ink holding member at the time of said liquid supply being judged according to the judgment of said liquid holding condition.

10. A liquid ejection recording apparatus according to claim 8, further comprising detecting means for detecting the remaining amount of ink in the atmosphere communicating type liquid accommodating chamber of said integral tank, and a control section for controlling so as to connect the preparatory chamber of said integral tank to said large tank according to the output of said detecting means, wherein said detecting means supplies its output to said control section before the liquid flow in the portion of said ink holding member in the vicinity of the communication hole has been interrupted.

11. A liquid ejection recording apparatus comprising:

a carriage which carries at least one head cartridge including a tank section holding a liquid and a recording head for performing recording on a recording material, said carriage being arranged to reciprocate along a straight line that is parallel to said recording material; and a large tank holding a large amount of the same liquid as held in said tank section, and being connectable to said tank section at a predetermined position to thereby supply the liquid to said tank section;

wherein said tank section includes a first chamber provided with a negative pressure generating member which generates negative pressure to the recording head and an atmosphere-communication opening communicating with the atmosphere, and a second chamber which is next to said first chamber in communication with the first chamber so as to form a substantially closed space except for such communication, wherein said large tank connects to said second chamber of said tank section only at said predetermined position while the second chamber is substantially closed to the atmosphere; and wherein said large tank is not connected to said tank section except in a state to supply the liquid to said tank section.

12. A liquid ejection recording apparatus according to claim 11, wherein said predetermined position is a position in which negative pressure is applied to said large tank.

13. A liquid ejection recording apparatus according to claim 11, wherein the tank section is arranged at a position nearest to a recording region of said apparatus.

14. A liquid ejection recording apparatus according to claim 11, wherein said liquid is ink.

15. A liquid ejection recording apparatus comprising:

a carriage which carries at least one head cartridge including a tank section holding a liquid and a recording head for performing recording on a recording material, said carriage being arranged to reciprocate along a straight line that is parallel to said recording material; and a large tank holding a large amount of the same liquid as held in said tank section, and being connectable to said tank section at a predetermined position to thereby supply liquid to said tank section;

wherein said tank section includes a first chamber provided with a negative pressure generating member which generates negative pressure to the liquid ejection head and an atmosphere-communication opening communicating with the atmosphere, and a second chamber which is next to said first chamber communicating with the first chamber at a communication part and which is open to the atmosphere and the apparatus further comprising detecting means for detecting the remaining amount of liquid in the second chamber, and a control section for controlling so as to connect the tank section to said large tank according to the output of said detecting means, wherein said detecting means supplies detection output to said control section before flow of liquid through said communication part has been interrupted; and wherein said large tank is not connected to said tank section except in a state to supply the liquid to said tank section.

16. A liquid ejection recording apparatus according to claim 15, wherein said predetermined position is a position in which negative pressure is applied to said large tank.

17. A liquid ejection recording apparatus according to claim 15, wherein the tank section is arranged at a position nearest to a recording region of said apparatus.

18. A liquid ejection recording apparatus according to claim 15, wherein said liquid is ink.

19. A liquid ejection recording apparatus according to claim 15, wherein a bottom surface of said second chamber is inclined toward said communication part.

20. A liquid ejection recording apparatus according to claim 15, wherein a bottom surface of said second chamber is inclined.

21. A liquid ejection recording apparatus comprising:

a carriage which carries plural head cartridges each consisting of an ink tank holding a liquid and a recording head for performing recording on a recording material, the plural ink tanks holding respectively different kinds of liquid, said carriage being arranged to reciprocate along a straight line that is parallel to said recording material so as to form a color image on said recording material; and ink supply means for supplying ink to a particular ink tank of said ink tanks, the particular ink tank having a relatively large capacity and having an ink receiving structure, said ink supply means being arranged at a predetermined position;

wherein there are two of said particular ink tanks, the supply positions of said two ink tanks being situated opposite to each other with a recording region of said apparatus therebetween; and wherein said ink supply means is not connected to said particular ink tank except in a state to supply the liquid to said particular ink tank.

22. A liquid ejection recording apparatus comprising:

a carriage which carries plural head cartridges each consisting of an ink tank holding a liquid and a recording head for performing recording on a recording material, the plural ink tanks holding respectively different kinds of liquid, said carriage being arranged to reciprocate along a straight line that is parallel to said recording material so as to form a color image on said recording material;

ink supply means for supplying an amount of ink to a particular ink tank of said ink tanks, the particular ink tank having a relatively large capacity and having an ink receiving structure, said ink supply means being arranged at a predetermined position;

detecting means for detecting a remaining amount of ink in the particular ink tank, and a control section for supplying additional ink from said ink supply means to the particular ink tank in accordance with detection information obtained by said detecting means; and a valve member driving means for opening and closing a valve member for stopping an atmosphere communicating hole of said ink supply means, said valve member being opened by operating said valve member driving means in accordance with the detection information obtained by said detecting means, the ink being supplied from said ink supply means to the particular ink tank.

* * * * *